United States Patent [19]

Cadwell

[11] Patent Number: 5,016,805

[45] Date of Patent: May 21, 1991

[54] METHOD AND APPARATUS FOR DUAL SUPERPLASTIC FORMING OF METAL SHEETS

[75] Inventor: Gilbert C. Cadwell, Lakeside, Calif.

[73] Assignee: Rohr Industries, Inc., Chula Vista, Calif.

[21] Appl. No.: 264,984

[22] Filed: Oct. 31, 1988

[51] Int. Cl.[5] ..... B21C 37/02

[52] U.S. Cl. ..... 228/118; 228/157; 228/160; 228/190; 228/193

[58] Field of Search ..... 228/106, 118, 15.1, 228/157, 144, 160, 190, 193, 173.6, 161; 72/54, 342

[56] References Cited

U.S. PATENT DOCUMENTS

| | | | |
|---|---|---|---|
| 3,927,817 | 12/1975 | Hamilton et al. | 228/157 |
| 3,934,441 | 1/1976 | Hamilton et al. | 72/60 |
| 4,291,566 | 9/1981 | Dinsdale | 72/347 |
| 4,478,589 | 10/1984 | Takenaka et al. | 228/191 |
| 4,635,461 | 1/1987 | Raymond | 72/407 |

*Primary Examiner*—Michael J. Carone
*Attorney, Agent, or Firm*—Patrick J. Schlesinger

[57] ABSTRACT

A pair of sheets of a metal capable of exhibiting superplasticity, such as Titanium, are placed in overlapping relationship and the peripheral edges of the sheets are joined, such as by welding, to provide a gas impervious seal. The joined metal sheets are lowered into a press so that they extend vertically between a pair of horizontally spaced apart, vertically extending preheated ceramic dies. The dies are previously transferred inside insulating shrouds from a preheater station before being loaded into the press. At least one of the dies is moved horizontally toward the other one of the dies so that the joined metal sheets are positioned closely adjacent to the dies. As a result, the metal sheets are heated to a predetermined temperature at which they are capable of exhibiting superplasticity. Thermostatically controlled heating platens behind the dies offset any heat losses in the dies as they radiate energy to the joined metal sheets. Thereafter a pressurized gas, such as Argon, is introduced between the joined metal sheets so that they are pushed outwardly against corresponding ones of the dies and formed against the same. At least one of the dies is thereafter moved horizontally away from the other one of the dies and the formed metal sheets are lifted out of the press. The formed metal sheets are then transferred to a cooling station. Once cooled, the formed metal sheets are cut apart to produce two or more formed pieces.

30 Claims, 5 Drawing Sheets

3/5
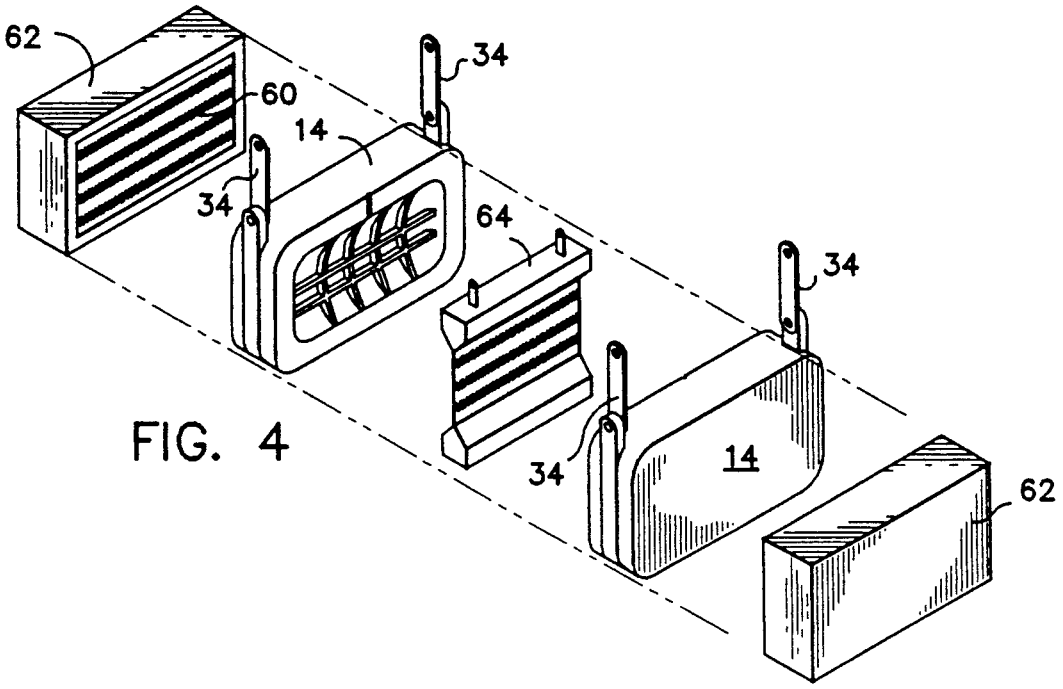
FIG. 4
FIG. 5
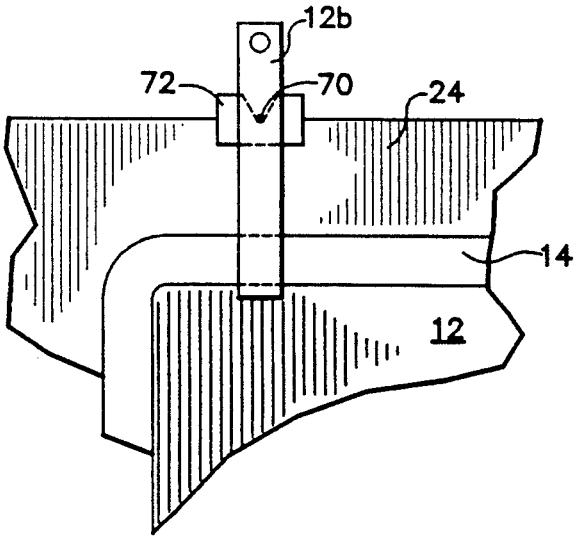
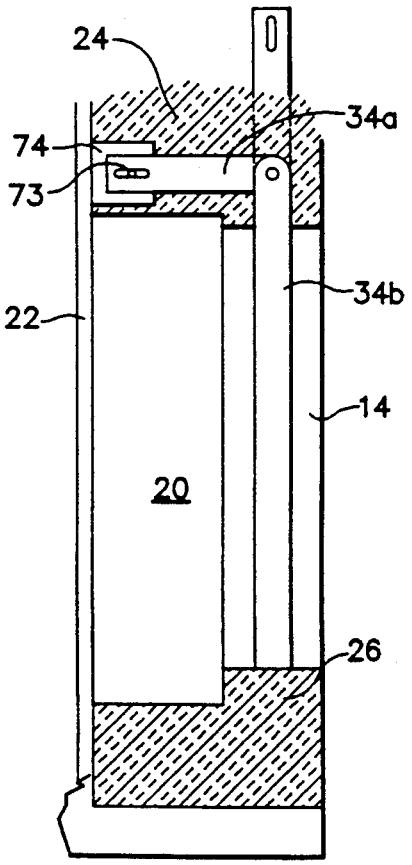
FIG. 6

METHOD AND APPARATUS FOR DUAL SUPERPLASTIC FORMING OF METAL SHEETS

BACKGROUND OF THE INVENTION

The present invention relates to forming metal parts, and in particular, to an improved method and apparatus for simultaneously forming two parts from a pair of vertically oriented metal sheets while they are in a superplastic state.

For many years it has been known that certain metals, such as Titanium, as well as certain metal alloys, exhibit superplasticity within limited temperature ranges and strain rates. Superplasticity is the capability of a material to develop unusually high tensile elongations with a reduced tendency towards necking. Thus when in a superplastic condition, the metal or metal alloy exhibits low resistance to deformation and may be elongated with controlled thinning. This permits a sheet of such metal to be readily formed against dies to achieve desired shapes while maintaining a substantially uniform thickness in the finished part without any weak points. Superplastic forming (SPF) may be performed in conjunction with diffusion bonding. Diffusion bonding refers to metallurgical joining of surfaces of similar or dissimilar metals by holding them in physical contact and applying heat and pressure sufficient to cause commingling of the atoms at the junction. Further details of both SPF and diffusion bonding may be had by way of reference to U.S. Pat. No. 3,934,441 of Hamilton et al. entitled "Controlled Environment Superplastic Forming of Metals" and U.S. Pat. No. 3,927,817 of Hamilton et al. entitled "Method of Making Metallic Sandwich Structures."

U.S. Pat. No. 4,635,461 of Raymond entitled "Vertical Press" discloses a press for SPF or a combination of diffusion bonding and SPF, which may be utilized to make metallic sandwich structures. It has a pair of vertical ram assemblies, one of which is moved horizontally by four jack screws and the other one of which is moved horizontally by a pair of hydraulic cylinders. Four other hydraulic cylinders located at the corners of the latter ram assembly are used to align the same with respect to the tooling. A stack of three Titanium worksheets is formed by closing the ram assemblies to squeeze the sheets between metal tools which are backed by metal heating platens and ceramic insulator blocks. A seal in one of the tools is buried in the work sheets when the ram assemblies are fully closed so that gas pressure can be applied to effect diffusion bonding. Interlocking support members extend horizontally from the bottom of each of the ram assemblies for supporting the heavy metal tools, the worksheets, the heating platens and the insulator blocks. These elements all slide horizontally when the ram assemblies are separated. Tooling brackets may be attached to secure each insulator, heating platen and tooling die together.

The structure of the vertical press of U.S. Pat. No. 4,635,461 of Raymond has a tendency to sag. Considerable time is needed for the tooling to heat up in the press, which results in lower throughput. The use of both a fluid press and a screw press makes closure of the press complicated and time consuming. Significant temperature recovery time during the loading and unloading cycles also limits throughput. The metal heating platens tend to warp. The metal tooling is heavy and expensive. The vertical press of the Raymond patent is particularly adapted for forming a single three piece sandwich structure which requires that the edges of the sheets be firmly clamped via the imbedded seal in the tooling. This prevents inward slippage of the sheet edges. However, this approach is not compatible with tooling having relatively large horizontal recesses. With such tooling uniform thicknesses can only be achieved if the edges of the metal sheets can be vertically drawn in to accommodate substantial outward stretching of the sheets.

SUMMARY OF THE INVENTION

Therefore the primary objects of the present invention are to provide an improved SPF method and apparatus.

In accordance with the preferred embodiments of my method and apparatus a pair of sheets of a metal capable of exhibiting superplasticity, such as Titanium, are placed in overlapping relationship and the peripheral edges of the sheets are joined, such as by welding, to provide a gas impervious seal. The joined metal sheets are lowered into a press so that they extend vertically between a pair of horizontally spaced apart, vertically extending preheated ceramic dies. The dies are previously transferred inside insulating shrouds from a preheater station before being loaded into the press. At least one of the dies is moved horizontally toward the other one of the dies so that the joined metal sheets are positioned closely adjacent to the dies. As a result, the metal sheets are heated to a predetermined temperature at which they are capable of exhibiting superplasticity. Thermostatically controlled heating platens behind the dies offset any heat losses in the dies as they radiate energy to the joined metal sheets. Thereafter a pressurized gas, such as Argon, is introduced between the joined metal sheets so that they are pushed outwardly against corresponding ones of the dies and formed against the same. At least one of the dies is thereafter moved horizontally away from the other one of the dies and the formed metal sheets are lifted out of the press. The formed metal sheets are then transferred to a cooling station. Once cooled, the formed metal sheets are cut apart to produce two or more formed pieces.

BRIEF DESCRIPTION OF THE DRAWINGS

FIG. 4 is an exploded perspective view illustrating the relationship of the ceramic dies to the components of the preheater station.

FIG. 5 is an enlarged fragmentary view illustrating details of the manner in which the Titanium sheets are suspended in the press.

FIG. 6 is an enlarged, fragmentary side elevation view of the press of FIG. 1 illustrating details of the manner in which the ceramic dies are suspended.

DESCRIPTION OF THE PREFERRED EMBODIMENTS

Figure 1:
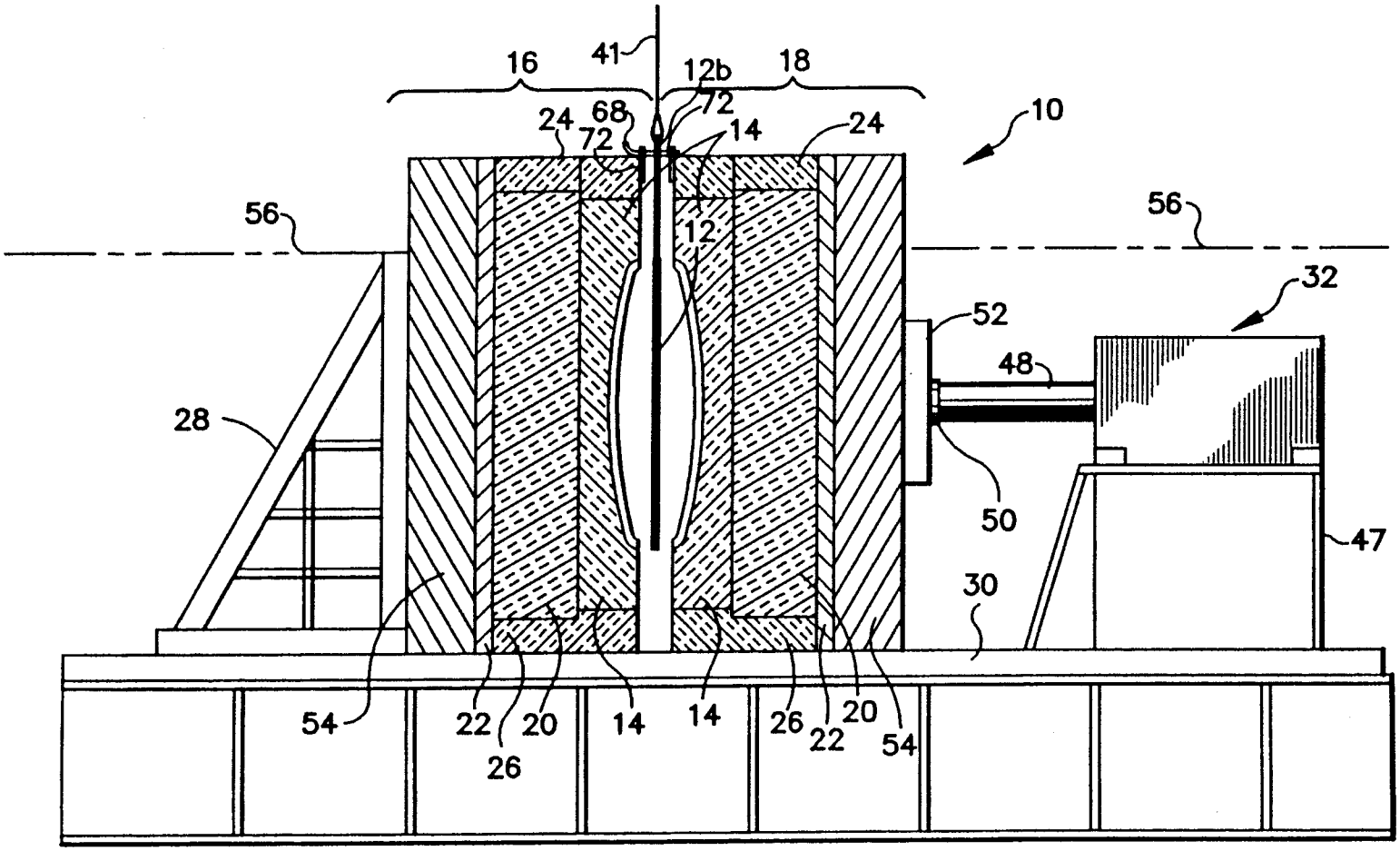
FIG. 1 is a simplified vertical sectional view of a preferred embodiment of a vertical press in accordance with my invention.

Referring to FIG. 1, an illustrated embodiment of my press 10 is adapted for superplastic forming (SPF) of Titanium parts against a pair of heated ceramic dies. Two titanium sheets 12 are welded together around their periphery with a gas tube (not visible) inserted between the sheets to provide for the subsequent admittance of pressurized gas. The ceramic dies 14 are first preheated and then carried inside an insulating shroud (not shown) to the press where they are lowered between two horizontally spaced, vertically extending ram assemblies 16 and 18 each including ceramic heating platens 20 and metal bolsters 22, as well as upper and lower ceramic insulating blocks 24 and 26. One ram assembly 16 is fixed via bracing 28 and the other ram assembly 18 is horizontally reciprocable on tracks 30 via hydraulic cylinder and piston assembly 32. The top of each ceramic die is suspended from articulating handling straps 34 (FIG. 4) which removably connect to the upper portion of a corresponding one of the ram assemblies as best see in FIG. 6. The welded Titanium sheets are lowered between the ceramic tooling via cables 36 (FIG. 3) connected to a lift bar 38 suspended from an overhead electric lift crane 40 via cable 41 (FIG. 1). The overhead crane is moveable along mono-rail tracks 42.

After the Titanium sheets 12 have been loaded into the vertical press 10 the moveable ram assembly 18 is closed to sandwich the Titanium sheets therebetween. Once the Titanium has reached the predetermined temperature at which it achieves super plasticity, Argon gas is introduced and the pressure thereof is gradually increased to force each sheet outwardly against its corresponding ceramic die 14 to thereby mold the desired shape. The moveable ram assembly and its attached die are then opened and the now-molded Titanium sheets are lifted from the press for finish trimming.

Figure 2:
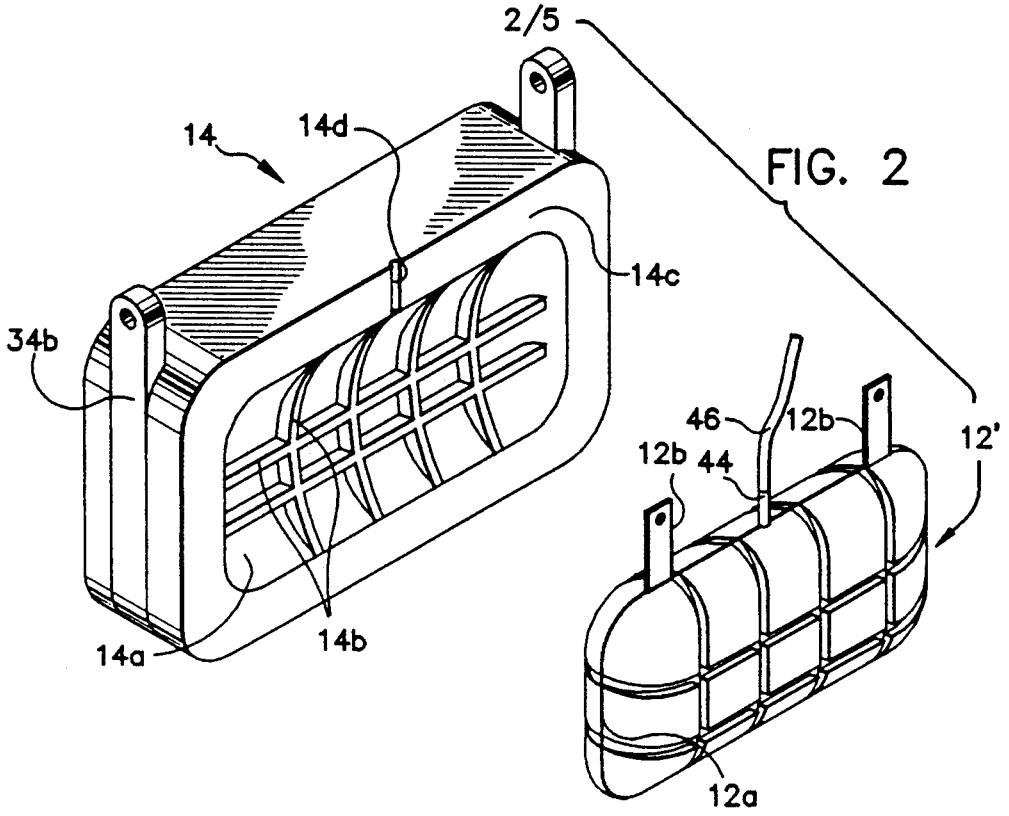
FIG. 2 is an enlarged perspective view of a pair of Titanium sheets after they have been formed in the press of FIG. 1. This figure also illustrates one of the ceramic dies used in the press.

FIG. 2 illustrates the two Titanium sheets 12' after they have been formed in the press. One of the ceramic dies 14 is also illustrated is this figure. It includes a generally convex surface 14*a* with intersecting horizontal and vertical ribs 14*b*. The Titanium sheets 12', which may be collectively referred to as a part blank, are formed in the die cavities defined by the opposing convex surfaces 14*a* of the pair of dies 14. While in the preferred embodiment of my method the sheets are Titanium, other metals and metal alloys may be similarly formed under superplastic conditions and therefore the term "metal capable of exhibiting superplasticity" should be understood to include the same.

Referring still to FIG. 2, the surrounding peripheral edges of the Titanium sheets are joined together by a weld bead 12*a*. Upper integral bracket portions or handling straps 12*b* extend from the top peripheral edge of the Titanium sheets and provide a means for connecting the lift cables 36 thereto. The cables may have hooks (not illustrated) which extend through holes in the bracket portions. A metallic gas tube 44 is shown extending from between the upper edges of the Titanium sheets. This tube is in turn connected to a hose 46 which extends upwardly to the overhead crane 40 and then to a variable pressure source of Argon gas (not illustrated). Other inert gases my be used.

Referring to FIG. 1, the hydraulic cylinder and piston assembly 32 is supported by a stand 47 secured to one end of the tracks 30. The remote end of a piston rod 48 that extends from the hydraulic piston and cylinder assembly 32 is pivotally coupled via gimbal 50 to a bracket 52. This bracket is rigidly attached to the rear side of vertical support 54 that backs the corresponding bolster 22 of the moveable ram assembly 18. The gimbal 50 allows the moveable ram assembly 18 to self-center during closure of the vertical press.

Preferably my press 10 is installed in a pit, i.e. substantially below floor level. This helps to minimize heat dissipation and thereby reduce the amount of electric power otherwise required to maintain the very high temperatures required to achieve superplasticity. The level of the floor is indicated in FIG. 1 by a horizontal phantom line 56. Since the press may be a tall structure, e.g. eight feet, the below-ground installation also serves to reduce the required height of the overhead mono-rail tracks 42 (FIG. 3) necessary to permit vertical loading and unloading of the press.

Figure 3:
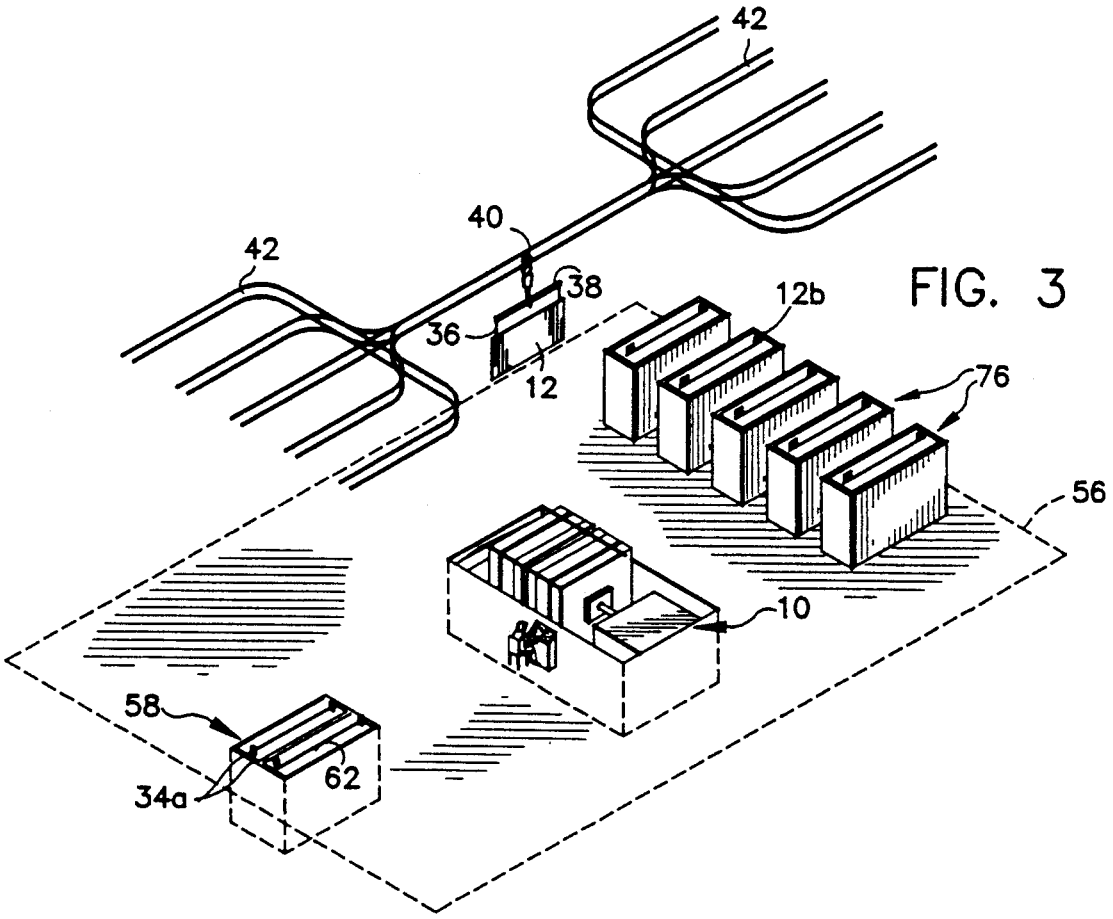
FIG. 3 is a simplified layout of the die preheater station, press and cooling station along with an overhead mono-rail crane that may be used to practice the method of the present invention.

Referring to FIG. 3, the ceramic dies 14 are first loaded into a die preheater station 58 via overhead crane 40. Here they are heated to an elevated temperature, e.g. 1750 degrees F. for Titanium, so that they will not have to be preheated in the vertical press. The press 10 has smaller heaters (not shown) for maintaining the temperature required for SPF. This lessens the amount of time that the press is inoperative, which would otherwise be substantial since the ceramic dies are frequently replaced when small lots of parts are being fabricated. Accordingly, the number of sheets that can be molded with the press during a given shift at the plant is substantially increased. Preferably the die preheater station 58 is also mounted in a pit, i.e. substantially below floor level 56, in order to minimize heat loss.

FIG. 4 is an exploded perspective view illustrating the relationship of the ceramic dies 14 to the components of one section of the preheater station 58. It includes a pair of outer electrical resistance type radiant heating elements, one of which is visible at 60, which are mounted in surrounding insulating blocks 62. A central heating element 64 radiates the inner cavities of each of the ceramic dies 14.

Figure 7:
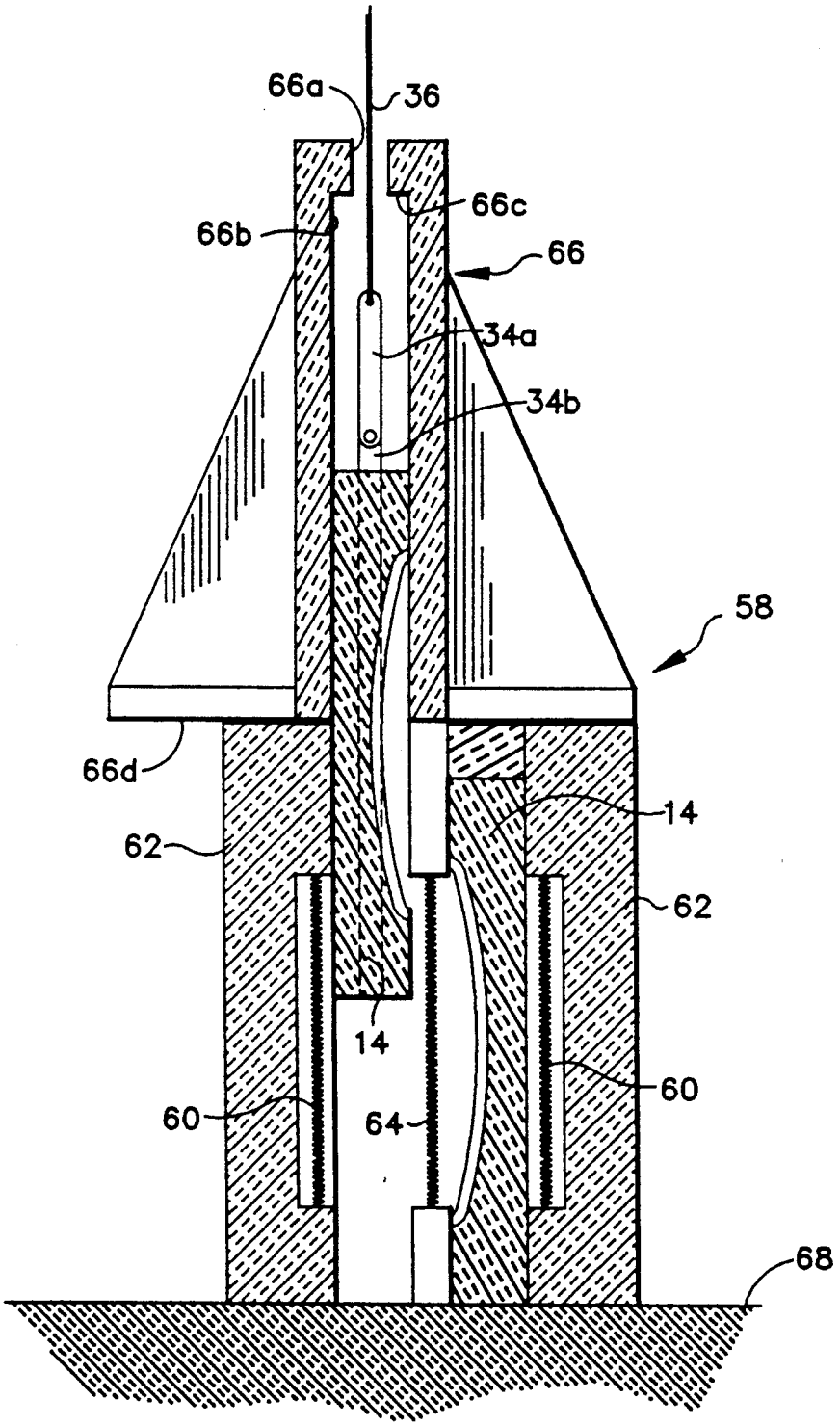
FIG. 7 is a vertical sectional view of one section of the preheater station showing the removal of a heated ceramic die into an insulating shroud.

FIG. 7 is a vertical sectional view of the preheater station 58 showing the removal of a heated ceramic die 14 inside an insulating shroud 66. The ceramic dies, when heated to very high temperatures, will fracture or otherwise be damaged through thermal shock if they are immediately exposed to ambient air. Also, the insulating shroud insures that there will be very little heat loss when the dies are transferred from the preheater station 58 to the vertical press 10 via the overhead crane as it travels along the overhead mono-rail tracks 42. The cables 36 extend downwardly through apertures 66*a* in the upper end of the shroud 66 and connect to the upper handling strap portions 34*a* that extend from the die. The ceramic die 14 is received in a vertical cavity 66*b* inside the shroud. The upper edges of the die abut against shoulders 66*c* of the shroud so that lifting of the die also lifts the shroud. The shroud 66 has a generally triangular configuration which affords a broad base 66*d* for sitting on top of the preheater station 58, the ram assemblies 16 and 18, or an insulated floor of a cooling station. Hot ceramic dies inside shrouds are set on insulated floors so that they will cool slowly to protect the dies from thermal shock after use. The preheater station has an insulating floor 68 to minimize downward heat loss.

Figure 8:
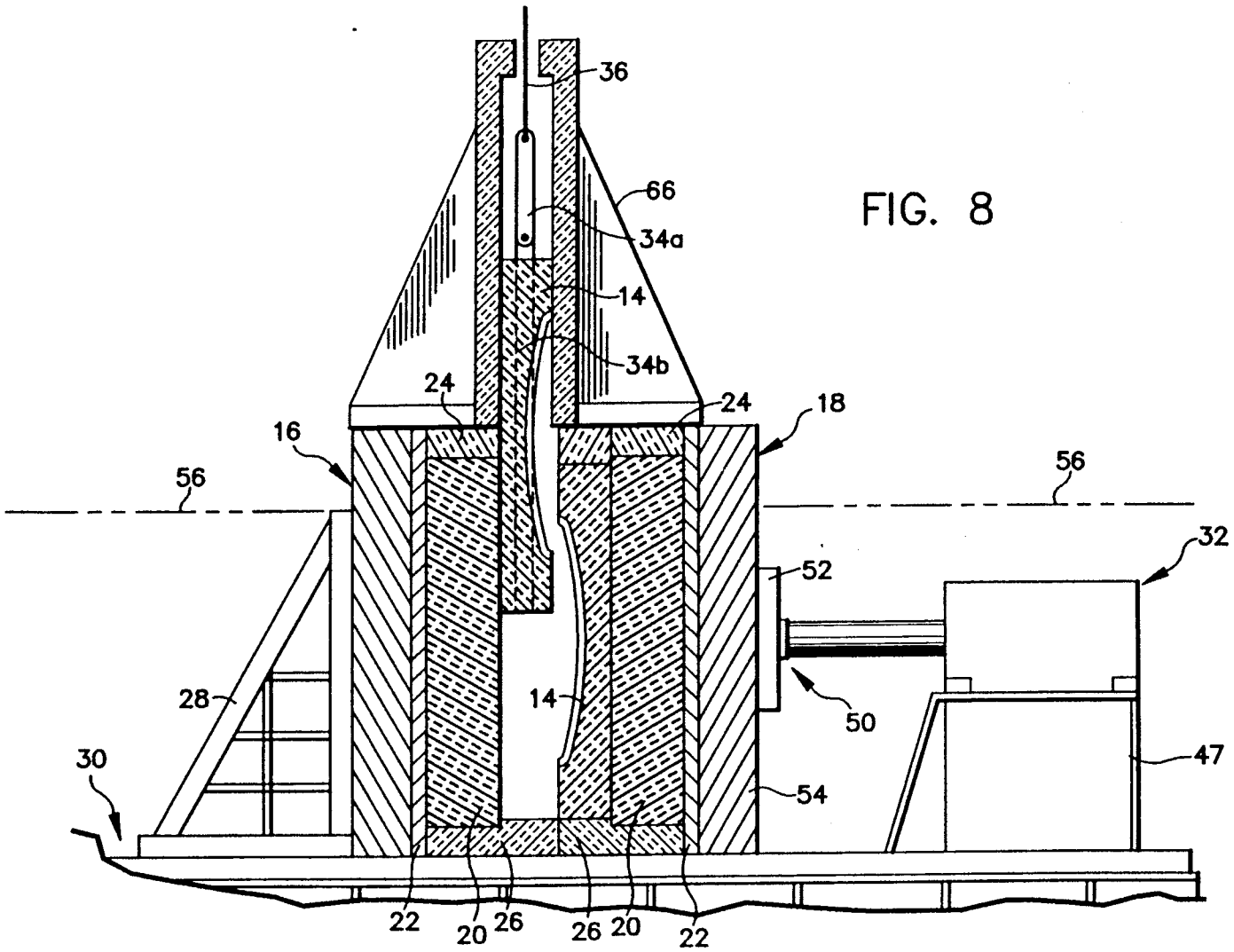
FIG. 8 is a fragmentary vertical sectional view similar to that of FIG. 1 showing the loading of the heated ceramic die into the vertical press.

FIG. 8 is a fragmentary vertical sectional view similar to that of FIG. 1 showing the loading of the heated ceramic die 14 into the vertical press 10. Again the base 66*d* of the triangular shaped insulating shroud 66 is rested on top of the separated ram assemblies 16 and 18 with its cavity 66*b* aligned between therebetween. In order to accomplish this loading, one of the upper insulating blocks 24 may be temporarily removed to provide an insertion slot. The other preheated die 14 is already shown inserted into position in FIG. 8.

After each of the dies has been inserted into the press 10 (FIG. 8) the insulating shroud 66 is removed and the upper insulating blocks 24 are replaced. As illustrated in FIG. 6, the upper portions 34*a* of the articulating handling straps are folded back around opposite sides of the corresponding upper insulating block 24 and are held via pins 73 or otherwise affixed to mounting fixtures 74. The lower portion 34*b* of each of the mounting straps may extend around the sides and bottom of the ceramic dies 14.

Once a corresponding pair of preheated ceramic dies 14 has been inserted into the press 10 (FIG. 1), the ram assembly 18 is briefly moved away from the fixed ram assembly 16. This provides enough clearance to permit the twin welded-together Titanium sheets 12, which overlie each other, to be lowered into the press via overhead crane 40, cable 41, lift bar 38 and cables 36 (FIG. 3). As best seen in FIGS. 1 and 5, locating means in the form of pins 70 and "V-groove" locators 72 associated therewith engage predetermined ones of the insulator blocks 24 to support the Titanium sheets in proper orientation between the heated ceramic dies 14. The ram assembly 18 is then closed against the surfaces of the adjacent die 14. The peripheral edges of the Titanium sheets are not squeezed between the die faces and a relief 14*d* (FIG. 2) in the dies prevents the tubing 44 from being flattened.

Once the joined Titanium 12 sheets have been loaded into the press as illustrated in FIG. 1 they are allowed to come up to temperature. This happens rapidly since they are closely adjacent to the preheated ceramic dies 14. Electrical resistance type heater elements (not visible) are embedded in the ceramic heating platens 20. They are thermostatically controlled and serve to maintain the desired temperature, e.g. 1650 plus or minus 50 degrees F., at which superplasticity of the Titanium sheets is achieved. Thereafter Argon gas is gradually injected between the sheets via tubing 44 and hose 46 and raised to a pressure of, for example, 100 to 300 PSI. The pressure is gradually increased to expand the part at the proper strain rate until the dies limit further part movement. It may be only 20 PSI for a simple dome, but in the instance of a hat section having a sharp radius, the pressure required may be 300 PSI, requiring clamping pressures of 600 tons or more. The opposite metal sheets are gradually blown outwardly into contact with their corresponding dies 14. Once full contact between the Titanium sheets and the ceramic dies is achieved, the pressure is maintained to form the superplastic metal against the convex surfaces 14*a* and ribs 14*b* (FIG. 2) of the dies. As the metal sheets move outward, the peripheral edges of the sheets slide inwardly along the smooth peripheral surfaces 14*c* (FIG. 2) of the dies. This readily occurs since the peripheral edges of the Titanium sheets are not squeezed or clamped between the peripheral die surfaces 14*c*. It is not necessary that a gas impervious seal be created by clamping tooling about the edges of the metal sheets.

Once the part 12' (FIG. 2) has been completely formed, the press goes through a controlled pressure drop to atmospheric pressure. The moveable ram assembly 18 is then pulled back. The hot formed part is then lifted and carried via the overhead crane 40 to a cooling station, a plurality of which are labeled 76 in FIG. 3. The formed Titanium part is allowed to cool in ambient air. The cooled part 12' may then be carried by the overhead crane to one or more machining stations where the two halves may be cut apart, e.g. with laser cutting tools. The separated parts may be further machined, e.g. to cut out the sections between the formed ribs to provide a lightweight bulkhead of interconnecting, integrally formed beams.

The advantages of my method and apparatus are numerous. Two formed metal parts or so-called "pans" are made during each cycle of the press, instead of one part as heretofore has been conventional. Little or no die heat up time is required in the press, since the dies are first heated in a preheater station. There is minimum temperature recovery time during the loading and unloading cycles. The ceramic heating platens will not warp as is the case with conventional metal platens which would cause the fracture of the adjacent ceramic dies. The ceramic dies are in compression during the forming cycle and female dies can be used without fracturing. Thus my invention permits broader use of far less expensive ceramic tooling than was heretofore possible. The foregoing advantages can result in a five-hundred percent increase in press throughput over conventional SPF presses.

My invention allows the dies to be loaded and unloaded from the press at high temperatures, without thermal shock. The life of the ceramic tooling is significantly increased as a result of the handling and storing in vertical attitude in accordance with my invention. The part blanks, i.e. the flat joined Titanium sheets, can be loaded and unloaded in a vertical attitude, thereby simplifying handling. The ceramic heating platens can be replaced in minutes if they should fail, or if they should require maintenance. The subterranean location of the press reduces operating heat losses. My method an apparatus are particularly well suited for manufacture of jet aircraft engine nacelle parts including aprons, fan cowl longerons, core cowls, pylon panels, inlet anti-icing bulkheads, engine mounts, torque beams, fire shields and fan blades.

While I have described preferred embodiments of my method and apparatus for dual SPF, it should be understood that modifications and adaptations thereof will occur to persons skilled in the art. For example, they may be readily modified to permit both SPF and diffusion bonding. While I have illustrated and described two part blanks being joined and blown to simultaneously form two parts, the same press could be used to form one part. One part blank could be welded to a flat plate and a flat ceramic plate could be inserted in place of one of the dies. Therefore, the protection afforded my invention should only be limited in accordance with the scope of the following claims.

I claim:

1. A method of dual super plastic forming comprising the steps of:

selecting a pair of sheets of a metal capable of exhibiting superplasticity;

placing the sheets in overlapping relationship and joining the peripheral edges of the sheets to provide a gas impervious seal;

lowering the joined metal sheets into a press so that they extend vertically between a pair of horizontally spaced apart, vertically extending heated dies;

moving at least one of the dies horizontally toward the other one of the dies so that the joined metal sheets are positioned closely adjacent to the dies;

allowing the metal sheets to be heated to a predetermined temperature at which they will be capable of exhibiting superplasticity;

introducing a pressurized gas between the joined metal sheets so that the sheets are pushed outwardly against corresponding ones of the dies and formed against the same;

moving at least one of the dies horizontally away from the other one of the dies and lifting the formed metal sheets out of the press; and cutting the formed metal sheets apart to produce two formed pieces.

2. A method according to claim 1 wherein the sheets are made of Titanium.

3. A method according to claim 2 wherein the predetermined temperature is between about 1600 and 1700 degrees F. and the gas pressure is between about 100 and 300 PSI.

4. A method according to claim 1 wherein the gas is introduced so that the pressure thereof gradually increases.

5. A method according to claim 2 wherein the gas is Argon.

6. A method according to claim 2 wherein the dies are made of a ceramic material.

7. A method according to claim 1 and further comprising the steps of preheating the dies in a preheater station to the predetermined temperature and thereafter loading the preheated dies into the press before lowering the joined metal sheets into the press between the preheated dies.

8. A method according to claim 7 and further comprising the step of moving the dies from the preheater station to the press in an insulating shroud.

9. A method according to claim 1 and further comprising the step of moving the formed metal sheets from the press to a cooling station.

10. A method according to claim 1 in which the dies are continuously heated while in the press in order to maintain the predetermined temperature.

11. An apparatus for superplastic forming of metal sheets, comprising:

a first vertical ram assembly;

a second vertical ram assembly;

means for mounting at least one of the first and second ram assemblies for horizontal movement toward and away from the other ram assembly for sandwiching a pair of overlapping edge-joined metal sheets therebetween;

each ram assembly including a removable ceramic die against which a corresponding one of the metal sheets is formed, a removable ceramic heating platen positioned on a rear side of the die for maintaining the corresponding sheet at a predetermined temperature at which superplasticity may be achieved, and a metal bolster positioned on a rear side of the heating platen.

12. An apparatus according to claim 11 and further comprising a plurality of ceramic insulators mounted to an upper side and a lower side of each of the ram assemblies.

13. An apparatus according to claim 11 wherein the first ram assembly is fixed and the means for mounting the second ram assembly for horizontal movement includes a horizontal track for slidably supporting the second ram assembly and a hydraulic cylinder and piston assembly.

14. An apparatus according to claim 13 wherein the means for mounting the second ram assembly for horizontal movement further includes gimbal means for pivotally connecting a remote end of the piston to the second ram assembly.

15. An apparatus according to claim 13 wherein the first ram assembly is fixed to the track by a brace.

16. An apparatus according to claim 11 wherein each ram assembly further includes strap means for suspending the ceramic die adjacent the heating platen.

17. An apparatus accordingly to claim 11 and further comprising means for supplying a pressurized gas to an interior between the edge-joined overlapping metal sheets after the same have been heated to the predetermined temperature at which superplasticity may be achieved, the pressure being sufficient to blow each sheet against a corresponding one of the ceramic dies to form the same.

18. An apparatus according to claim 11 and further comprising locating means for suspending the edge-joined metal sheets from a set of upper edges of the ram assemblies.

19. An apparatus according to claim 11 and further including an insulating shroud having a cavity for receiving one of the ceramic dies and engageable with a set of upper edges of the ram assemblies for aligning the cavity with an opening between the ram assemblies so that a preheated die suspended inside the cavity can be lowered between the ram assemblies.

20. A method of dual super plastic forming comprising the steps of:

selecting a pair of sheets of a metal capable of exhibiting superplasticity;

placing the sheets in overlapping relationship and joining the peripheral edges of the sheets to provide a gas impervious seal;

preheating a pair of dies in a preheater station to a predetermined temperature at which the sheets are capable of exhibiting superplasticity;

loading the preheated dies into a press so that they are vertically extending and horizontally spaced apart;

lowering the joined metal sheets into the press so that they extend vertically between the pair of preheated dies;

moving at least one of the dies horizontally toward the other one of the dies so that the joined metal sheets are positioned closely adjacent to the dies;

allowing the metal sheets to be heated to the predetermined temperature;

introducing a pressurized gas between the joined metal sheets so that they are pushed outwardly against corresponding ones of the dies and formed against the same; and moving at least one of the dies horizontally away from the other one of the dies and lifting the formed metal sheets out of the press.

21. A method according to claim 20 and further comprising the step of cutting the formed metal sheets apart to produce two formed pieces.

22. A method according to claim 20 wherein the sheets are made of Titanium.

23. A method according to claim 22 wherein the predetermined temperature is between about 1600 and 1700 degrees F. and the gas pressure is between about 100 and 300 PSI.

24. A method according to claim 20 wherein the gas is introduced so that the pressure thereof gradually increases.

25. A method according to claim 22 wherein the gas is Argon.

26. A method according to claim 22 wherein the dies are made of a ceramic material.

27. A method according to claim 20 and further comprising the step of moving the dies from the preheater station to the press in an insulating shroud.

28. A method according to claim 20 and further comprising the step of moving the formed metal sheets from the press to a cooling station.

29. A method according to claim 20 in which the dies are continuously heated while in the press in order to maintain the predetermined temperature.

30. A method of dual super plastic forming comprising the steps of:

selecting a pair of Titanium sheets;

placing the Titanium sheets in overlapping relationship and joining the peripheral edges of the Titanium sheets to provide a gas impervious seal;

preheating a pair of ceramic dies in a preheater station to a predetermined temperature at which the Titanium sheets will exhibit superplasticity;

moving the preheated ceramic dies in an insulating shroud from the preheater station to a press;

loading the preheated ceramic dies into the press so that they are vertically extending and horizontally spaced apart;

continuously heating the ceramic dies while in the press in order to maintain them at the predetermined temperature;

lowering the joined Titanium sheets into the press so that they extend vertically between the pair of ceramic dies;

moving at least one of the ceramic dies horizontally toward the other one of the dies so that the joined Titanium sheets are positioned closely adjacent to the ceramic dies;

allowing the joined Titanium sheets to be heated to the predetermined temperature;

gradually introducing pressurized Argon gas between the joined Titanium sheets up to a pressure of between about 100 and 300 PSI so that the sheets are pushed outwardly against corresponding ones of the ceramic dies and formed against the same;

moving at least one of the ceramic dies horizontally away from the other one of the dies and lifting the formed Titanium sheets out of the press;

moving the formed Titanium sheets to a cooling station and allowing them to cool to ambient temperature;

removing the formed Titanium sheets from the cooling station; and cutting the formed Titanium sheets apart to produce two formed pieces.

* * * * *